US006910954B2

(12) United States Patent
Kim et al.

(10) Patent No.: US 6,910,954 B2
(45) Date of Patent: Jun. 28, 2005

(54) METHOD OF SUPPLYING SLURRY AND A SLURRY SUPPLY APPARATUS HAVING A MIXING UNIT AT A POINT OF USE

(75) Inventors: Sue-Ryeon Kim, Suwon (KR); Seung-Un Kim, Suwon (KR); Seung-Ki Chae, Seoul (KR); Je-Gu Lee, Hwsaung (KR); Seung-Hoon Ahn, Yongin (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 10/145,806

(22) Filed: May 16, 2002

(65) Prior Publication Data

US 2003/0100247 A1 May 29, 2003

(30) Foreign Application Priority Data

Nov. 28, 2001 (KR) ..... 2001-74547

(51) Int. Cl.[7] ..... B24B 1/00

(52) U.S. Cl. ..... 451/60; 451/36; 451/37; 451/41; 451/87; 451/91; 451/99; 451/287; 451/446

(58) Field of Search ..... 451/36, 37, 41, 451/60, 87, 91, 99, 100, 287, 446

(56) References Cited

U.S. PATENT DOCUMENTS 5,478,435 A 12/1995 Murphy et al.
5,957,759 A 9/1999 Cardenas et al.
6,059,920 A 5/2000 Nojo et al.
6,338,671 B1 * 1/2002 Kawashima et al. ..... 451/87
6,406,364 B1 * 6/2002 Kimura et al. ..... 451/446
6,457,852 B1 * 10/2002 Hiraoka et al. ..... 366/136

FOREIGN PATENT DOCUMENTS

JP 2000-202774 7/2000

* cited by examiner

*Primary Examiner*—Joseph J. Hail, III
*Assistant Examiner*—Shantese McDonald
(74) *Attorney, Agent, or Firm*—Lee, Sterba & Morse P.C.

(57) ABSTRACT

A computer-controlled slurry supplying apparatus for providing abrasive slurry to a chemical mechanical polishing (CMP) machine in a semiconductor manufacturing process preferably comprises a storage portion for accepting and storing a quantity of undiluted slurry, a mixing portion for accepting undiluted slurry from the storage portion and mixing with a diluting solution to created a diluted slurry, a supply portion for holding the diluted slurry, and at least one point-of-use mixing unit for mixing at least one chemical additive to the diluted slurry at or near a dispensing nozzle at the point of application. Each of the above portions of the slurry supplying apparatus further includes a re-circulation means for keep solutions in a mixed and agitated state. A method for using the slurry supplying apparatus comprises steps of controllably operating various valves, pumps, and sensors to maintain a desired slurry composition and flow rate.

30 Claims, 7 Drawing Sheets

METHOD OF SUPPLYING SLURRY AND A SLURRY SUPPLY APPARATUS HAVING A MIXING UNIT AT A POINT OF USE

BACKGROUND OF THE INVENTION

1. Field of the Invention

The present invention relates to generally to supplying slurry in manufacturing processes and, more particularly, to a method of supplying slurry and a slurry supply apparatus for supplying slurry to a chemical mechanical polishing (CMP) machine used in planarizing surfaces of semiconductor devices during semiconductor fabrication.

2. Description of Related Art

As semiconductor devices become more highly integrated, a planarization technique using a chemical mechanical polishing (CMP) machine is typically employed. The CMP machine typically uses a slurry comprised of an abrasive material and a diluting agent and possibly a curing agent to create a solution that has a polishing selectivity with respect to an underlying layer that acts as a CMP stopping layer. Selection of a particular slurry depends on the semiconductor layers to be palanarized. For example, a silica-based ($SiO_2$) slurry is typically used for planarizing a silicon oxide layer with a silicon nitride layer being used as the CMP stopping layer, while an alumina-based ($Al_2O_3$) slurry is widely used for planarizing a copper layer or a tungsten layer. Similarly, a ceria-based ($CeO_2$) slurry may be used for applications where a higher polishing selectivity than that of the silica-based slurry is required.

A conventional slurry supply apparatus for supplying the slurry to the CMP machine comprises a mixing tank wherein undiluted slurry is diluted with de-ionized water. The mixing tank may include one or more sensors for measuring and controlling the composition of the resulting slurry. The conventional slurry supply apparatus may further include a supply tank that stores the diluted slurry created in the mixing tank until it is delivered to a polishing pad of the CMP machine via delivery conduits.

Disadvantageously, unless the slurries are kept in an agitated or suspension state, abrasive particles will precipitate out of the solution and solidify in interconnecting conduits of the delivery system. Further, such precipitated particles flow out of the slurry supply apparatus in an irregular manner, thereby degrading the uniformity of the chemical mechanical polishing process. As a result, it is difficult to supply slurry having a uniform concentration and uniform mixing ratio to the polishing pad and thus difficult to perform a uniform, reliable and stable CMP process.

Conventional approaches to resolving the problems associated with precipitation and coagulation of particulates have been to either: 1) add a re-circulation loop to the conduit delivery system; or 2) combine the separate slurry component solutions as close to a point of use (POU) as possible (i.e. at the polishing pad of the CMP system.) In the re-circulation loop approach, additional conduits are arranged to form a re-circulation loop, wherein the pre-mixed diluted slurry solution is continuously pumped through the system conduits to keep the solution in an agitated or non-precipitating state. As a quantity of solution is required at the polishing pad, it is ported via a dispensing branch or conduit to a dispensing nozzle, and thence to the polishing pad. Alternatively, with the POU system, the separate chemicals are not mixed until a final stage of the supply conduit system, thus requiring no continuous agitation mechanism.

Both of these approaches have significant disadvantages that effect overall CMP system performance and quality. In the pre-mixed re-circulation system, slurry composition cannot be easily modified as system requirements change (i.e. to deliver a polishing abrasive having a different ratio of un-diluted slurry to diluting agent.) In the POU system, delivery of a properly mixed solution at the polishing pad cannot be guaranteed, resulting in a portion of a device being planarized using a very coarse and predominately un-diluted slurry while another portion of the device is planarized solely with the non-abrasive diluting solution. Further, when a curing agent is used, the pre-mixed slurry solution must be delivered and used within a predetermined period of time, before the slurry cures.

To overcome the pre-mixed slurry problem of the re-circulated approach and particularly the time limitations due to the curing additive, the CMP operation would necessarily be halted while the solution either was changed entirely or was re-mixed and re-circulated to attain a new solution mix ratio. In either event, any "old" solution that may remain in the conduits beyond the re-circulation loop toward the polishing pad would have to be removed to avoid contamination at the polishing pad before a new solution has traversed the dispensing conduit and nozzle.

To overcome the non-uniform mixing problem at the dispensing nozzle of the POU approach, the individual slurry component solutions may be combined at a conduit location a further distance back from the dispensing nozzle. This allows more turbulence mixing to occur before the slurry is dispensed. While such a displacement allows for an engineering tradeoff between a POU mix-change flexibility with more uniform mixing prior to the dispensing nozzle, the further away from the dispensing nozzle, the greater the chance of occurrence of the aforementioned changed-solution contamination and precipitation of the particulates in the un-agitated diluted slurry.

SUMMARY OF THE INVENTION

In the embodiments of the present invention, a slurry mixing and dispensing system preferably comprises one or more elements for the storage, mixing, pumping, filtering, and routing of a mixture of polishing slurry for applications in a chemical mechanical polishing (CMP) apparatus. Primary features include 1) re-circulation loops for keeping a slurry solution in an agitated and suspended state, and 2) providing efficient mixing of chemical additives, such as time-sensitive curing chemicals only at or near the point of use. By maintaining separate re-circulating loops for each chemical to be supplied as a component part of a CMP polishing compound, mixture uniformity can be attained. This allows for delayed mixing, which insures that unused pre-mixed polishing compound is not lost upon operational changes in a slurry composition or mixture. Each re-circulation loop may include pumps, valves, filters, and conduits for the porting and transfer of slurry and additive solution.

In a first embodiment according to the present invention, a system preferably comprises a source of an un-diluted slurry solution, a source of a diluting solution, and a source of a chemical additive solution, with necessary interconnecting conduits, valves, filters, and pumps for selectively delivering the solutions to an in-line mixing and dispensing unit. In the first embodiment, an un-diluted slurry storage tank is preferably connected directly to the in-line mixing and dispensing unit. The diluting solution source and the chemical additive source is also connected directly to the in-line mixing and dispensing unit. A computer preferably controls the process for transferring and mixing the various chemicals in a desired ratio as required by a particular CMP operation.

A first embodiment of a method for circulating and dispensing a polishing solution onto a surface of a semiconductor wafer according to the present invention comprises: 1) introducing an undiluted slurry solution to a storage tank, 2) pumping the undiluted slurry solution from the storage tank to an in-line mixing unit and then back to the storage tank, and 3) in response to a first signal from the controller, dispensing a controlled amount of the undiluted slurry solution onto the surface of the semiconductor wafer through the dispensing conduit via a first solution flow control valve in the in-line mixing unit.

Additionally, in response to a second signal from the controller, a second solution flow control valve in the in-line mixing unit may be used to introduce an additive solution for mixing with the undiluted slurry solution to form a first mixed solution, which is dispensed onto the surface of the semiconductor wafer through the dispensing conduit. The additive may be selected from polymeric solutions and oxidizing solutions.

Moreover, in response to a third signal from the controller, a third solution flow control valve may be used to introduce a third solution to the in-line mixing unit to be mixed with the first and second solution to form a second mixed solution, which is dispensed onto the surface of the semiconductor wafer through the dispensing conduit. The third solution may be, e.g., de-ionized water.

A slurry re-circulating and dispensing system according to an alternate embodiment of the present invention comprises: 1) a storage tank, having a re-circulation loop, for receiving and locally re-circulating an un-diluted slurry solution, 2) a mixing tank for mixing the un-diluted slurry with a diluting solution, such as de-ionized water, to create a diluted slurry solution, and 3) an in-line mixing unit for receiving the diluted slurry solution and optionally mixing it with a chemical additive to form the second mixed solution, which is dispensed onto the surface of the semiconductor wafer via a minimized length dispensing conduit.

An alternate method for circulating and dispensing a solution onto a surface of a semiconductor wafer according to the present invention comprises: 1) introducing an undiluted slurry solution to a storage tank, 2) in response to a first mixing control signal from the controller, pumping the undiluted slurry solution from the storage tank to a mixing tank to create a mixed solution, i.e., a diluted slurry solution, by adding a diluting solution, such as de-ionized water, 3) pumping the mixed solution from the mixing tank to an in-line mixing unit and back to the mixing tank to keep the particulates in suspension, and 4) in response to a slurry dispensing control signal from the controller, opening a slurry flow control valve in the in-line mixing unit to controllably dispense a quantity of the mixed solution through a dispensing conduit and onto a surface of a semiconductor wafer. For certain applications, the un-diluted slurry solution from the storage tank may be provided through the mixing tank to the in-line mixing unit without adding the diluting solution. The alternate method may also include an additional step of activating an additive flow control valve for introducing a quantity of chemical additive to the mixed solution, wherein the chemical additive may be one or more solutions selected from polymeric solutions and oxidizing solutions.

A slurry re-circulating and dispensing system according to a preferred embodiment of the present invention comprises: 1) a storage tank for receiving and locally re-circulating an un-diluted slurry solution, 2) a mixing tank for mixing the un-diluted slurry with a diluting solution, such as de-ionized water, to create a diluted slurry solution, 3) a supply tank for receiving the diluted slurry solution from the mixing tank, and 4) an in-line mixing unit for receiving and mixing the diluted slurry solution with a chemical additive, to form a second mixed solution, which is dispensed onto the surface of the semiconductor wafer via a dispensing conduit. It is also preferred that the dispensing conduit has a minimized length.

A preferred method for circulating and dispensing a polishing solution onto a surface of a semiconductor wafer according to the present invention, comprises: 1) introducing an un-diluted slurry solution to a storage tank having a local re-circulation loop for circulating the un-diluted slurry solution, 2) pumping the un-diluted slurry solution from the storage tank to a mixing tank in order to create a first mixed solution, 3) pumping the first mixed solution from the mixing tank to a supply tank, and 4) pumping the first mixed solution from the supply tank to an in-line mixing unit and back to the supply tank in order to re-circulate and maintain in suspension abrasive particulates contained in the first mixed solution, and 5) in response to a slurry dispensing control signal from the controller, opening a slurry flow control valve in the in-line mixing unit to controllably dispense a quantity of the first mixed solution through a dispensing conduit and onto the surface of the semiconductor wafer. The preferred method may also include an additional step of activating an additive flow control valve for introducing and mixing a quantity of chemical additive to the first mixed solution before being dispensed through the dispensing conduit and onto the surface of the semiconductor wafer.

In the above embodiments of the present invention, separate reservoirs are preferably provided for each of the slurry material and chemical additives. Each of these reservoirs are preferably provided with a re-circulating loop that keeps the respective solution uniform and in an agitated state until needed at the CMP point of use (POU). To dispense the required slurry and/or additives, an in-line mixing unit controllably opens an associated valve or valves to allow flow from the particular re-circulation loop to be dispensed. Solution mixtures (ratio of included compounds and solutions) may be measured using a sonic measuring means or by weighting means.

These and other features of the present invention will be readily apparent to those of ordinary skill in the art upon review of the detailed description that follows.

DETAILED DESCRIPTION OF THE INVENTION

Korean Patent Application No. 2001-74547, filed on Nov. 28, 2001, and entitled "Slurry Supply Apparatus having a Mixing Unit at a Point of Use and a Slurry Storage Unit," is incorporated by reference herein in its entirety.

Figure 1:
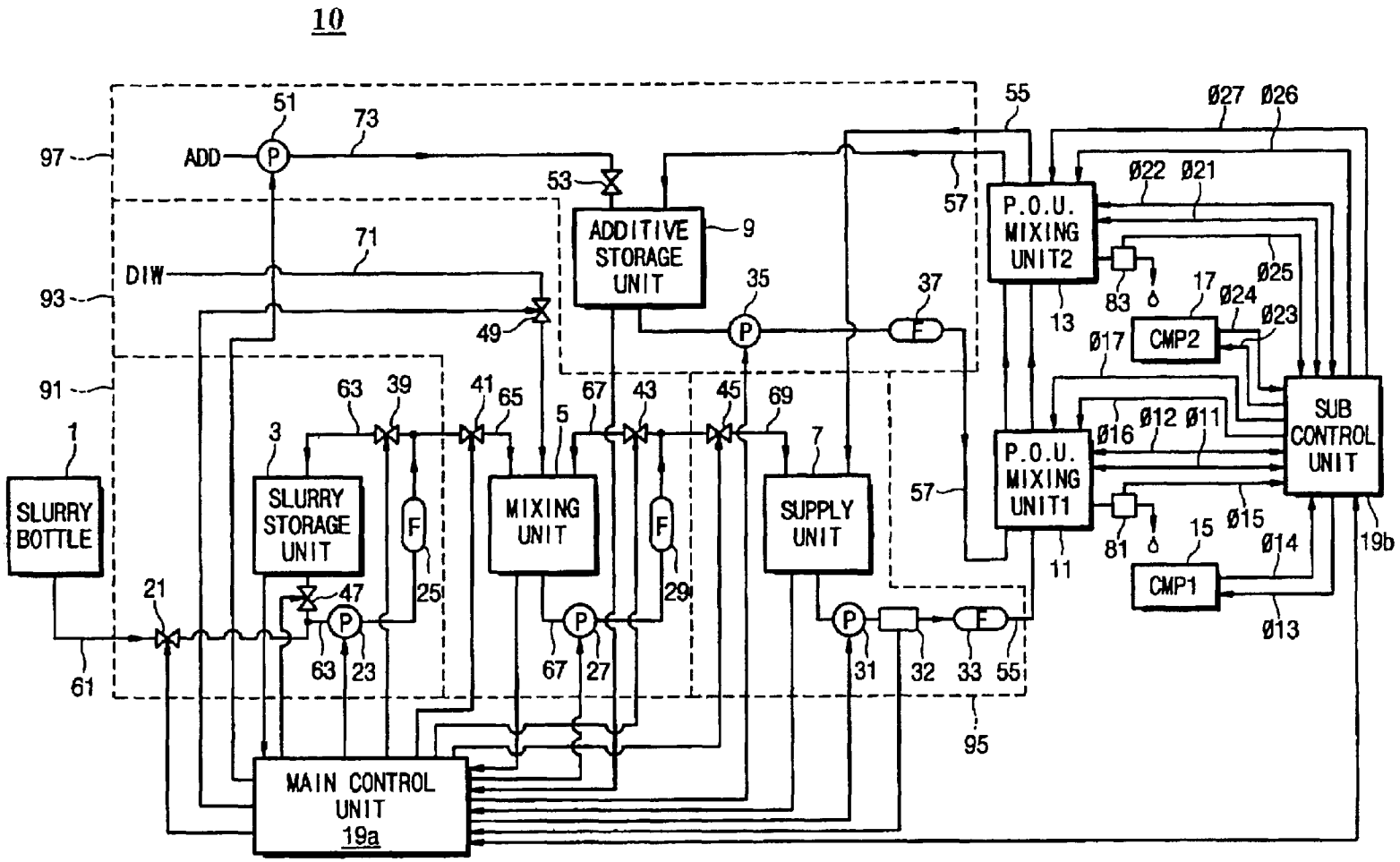
FIG. 1 illustrates a schematic diagram of a slurry supply apparatus according to a preferred embodiment of the present invention.

FIG. 1 illustrates a schematic diagram of a slurry supply apparatus 10 according to a preferred embodiment of the present invention.

Referring to FIG. 1, a slurry bottle 1 is connected via a first slurry conduit 61 to a slurry circulation loop line 63, which is installed outside a slurry storage unit 3. Preferably, first slurry conduit 61 is connected to slurry circulation loop line 63 at a point between a first pump 23 and an outlet of slurry storage unit 3. An inlet of slurry circulation loop line 63 is connected to the outlet of slurry storage unit 3, and an outlet of slurry circulation loop line 63 is extended into an entry port of slurry storage unit 3. Also, a first pump 23 is installed at a predetermined region in slurry circulation loop line 63. One or more electronic control units, such as a main control unit 19*a* and sub-control unit 19*b,* are preferably used to control the operation of the elements in the slurry supply apparatus 10.

Undiluted slurry, such as silica-based, ceria-based, or alumina-based slurry, may be stored in the slurry bottle 1, which is typically purchased from a supplier. The undiluted slurry contains abrasive particles, which aggregate or accumulate on the bottom of the slurry bottle 1 as time elapses. Accordingly, in order to uniformly disperse the abrasive particles in the undiluted slurry, slurry bottle 1 is preferably shaken either manually or using a shaker (not shown) before slurry bottle 1 is connected to slurry conduit 61.

A first slurry valve 21 is preferably installed at a predetermined region of the slurry conduit 61 to control the flow of the undiluted slurry in response to control signals from main control unit 19*a*. Also, a second slurry valve 47 is preferably installed in slurry circulation loop line 63 between the outlet of the slurry storage unit 3 and the connection point for slurry conduit 61. Second slurry valve 47 and first pump 23 are also preferably controlled by signals from main control unit 19*a*.

In the event that first slurry valve 21 is opened and second slurry valve 47 is closed while first pump 23 is operating, the undiluted slurry in the slurry bottle 1 is transferred into slurry storage unit 3 through slurry conduit 61 and slurry circulation loop line 63. It is preferable that the total amount of the undiluted slurry in the slurry bottle 1 is transferred into slurry storage unit 3 for only a relatively short period of time to avoid settling of the abrasive particles. The amount of the undiluted slurry in slurry storage unit 3 is preferably continuously measured and converted into an associated electrical signal, which is transmitted to main control 19*a*.

Subsequently, the undiluted slurry stored in slurry storage unit 3 is preferably self-circulated through slurry circulation loop line 63. By closing first slurry valve 21 and opening second slurry valve 47 while first pump 23 is operating, the undiluted slurry may be continuously circulated through slurry circulation loop line 63. Slurry conduit 61, slurry storage unit 3, slurry circulation loop line 63, first pump 23, first slurry valve 21 and second slurry valve 47 constitute a slurry storage portion 91 of slurry supply apparatus 10. Slurry storage portion 91 may further comprise a filter unit 25, which is installed in slurry circulation loop line 63 between the first pump 23 and the outlet of slurry circulation loop line 63 and/or a slurry circulation valve 39, which is installed between the filter unit 25 and the outlet of slurry circulation loop line 63. Slurry circulation valve 39 is preferably opened or closed by a signal from the main control unit 19*a* in order to allow a portion of the undiluted slurry to be re-routed on demand to a mixing unit 5 through a slurry supply conduit 65.

It is preferable that slurry supply conduit 65 be branched from a predetermined region of the slurry circulation loop line 63 between the first pump 23 and the outlet of slurry circulation loop line 63. More preferably, the slurry supply conduit 65 is branched from a predetermined region of the slurry circulation loop line 63 between the filter unit 25 and the slurry circulation valve 39.

A slurry supply valve 41 is preferably installed at a predetermined region of the slurry supply conduit 65 and is opened or closed by signals from the main control unit 19*a*. Upon closing of the slurry circulation valve 39 and opening of the slurry supply valve 41, a portion of the undiluted slurry, which is circulated through the slurry circulation loop line 63, is directed into the mixing unit 5.

In mixing unit 5, the undiluted slurry may be mixed with a diluting solution, such as de-ionized water, which is supplied into the mixing unit 5 through a diluting solution supply conduit 71. The diluting solution is preferably supplied from a main system fabrication line under high pressure. To control this supply of diluting solution, a diluting solution valve 49 is preferably installed at a predetermined region of the diluting solution supply conduit 71. Opening and closing of the diluting solution valve 49 is preferably controlled by the main control unit 19*a,* which in conjunction with complementary opening and closing of the slurry supply valve 41 allows a predetermined mixing ratio of undiluted slurry and diluting solution to be obtained.

The amount of diluted slurry in the mixing unit 5 is preferably sensed and converted into an electrical signal, which is transmitted to the main control unit 19*a*. The diluted slurry in mixing unit 5 may be self-circulated through a diluted slurry circulation loop line 67. A second pump 27 is preferably installed at a predetermined region of the diluted slurry circulation loop line 67 in order to circulate the diluted slurry, preferably under control of the main control unit 19*a*. Slurry supply conduit 65, slurry supply valve 41, mixing unit 5, diluted slurry circulation loop line 67, second pump 27, diluting solution supply conduit 71 and diluting solution valve 49 constitute a mixing portion 93 of slurry supply apparatus 10.

Mixing portion 93 may further comprise a diluted slurry circulation valve 43, which is installed between the second pump 27 and an outlet of the diluted slurry circulation loop line 67, as well as a filter unit 29, which is installed between the second pump 27 and the diluted slurry circulation valve 43. Also, it is preferable that the main control unit 19*a* controls the diluted slurry circulation valve 43 and the filter unit 29.

A portion of the diluted slurry, which is circulated through the diluted slurry circulation loop line 67, may be flowed into a supply unit 7 through a diluted slurry supply conduit 69. The diluted slurry supply conduit 69 is preferably branched from the diluted slurry circulation loop line 67 between the second pump 27 and the outlet of diluted slurry circulation loop line 67. More preferably, the diluted slurry supply conduit 69 is branched from the diluted slurry circulation loop line 67 between the filter unit 29 and the diluted slurry supply valve 43.

A diluted slurry supply valve 45 is preferably installed at a predetermined region of the diluted slurry supply conduit 69. Preferably, the main control unit 19*a* controls the opening and closing of the diluted slurry supply valve 45, which in conjunction with complementary opening and closing of the diluted slurry supply valve 43, supplies diluted slurry to the supply unit 7. The amount of diluted slurry contained in the supply unit 7 is preferably sensed and converted into an electrical signal, which is transmitted to the main control unit 19*a*.

The diluted slurry that is stored in the supply unit 7 is preferably circulated through a first circulation loop line 55 and a third pump 31, which is installed at a predetermined region of the first circulation loop line 55. Also, it is preferable that the main control unit 19*a* controls the operation of the third pump 31. The diluted slurry supply conduit 69, the diluted slurry supply valve 45, the supply unit 7, the first circulation loop line 55 and the third pump 31 constitute a supply portion 95 of slurry supply apparatus 10.

The supply portion 95 may further comprise a filter unit 33, which is installed in the first circulation loop line 55 between the third pump 31 and an inlet of supply unit 7, and a conductivity measurer 32, which is installed in the first circulation loop line 55 between the third pump 31 and the filter unit 33. The conductivity measurer 32 measures the conductivity of the diluted slurry, which is circulated through the first circulation loop line 55, and transmits the measurement result to the main control unit 19*a*. In the event that the measured mixing ratio is out of a range of the desired values, the main control unit 19*a* causes slurry supply valve 41 and/or the diluting solution valve 49 to be opened, thereby adjusting the mixing ratio of the diluted slurry in the mixing unit 5 to move within the range of the desired value.

Simultaneously with the mixing and storage of the slurry, an additive is preferably being supplied into an additive storage unit 9 through an additive supply conduit 73. Such an additive is used to adjust polishing selectivity and/or the curing properties of the diluted slurry and may comprise a polymeric solution, such as polycarboxylate, polyammonium, polysulfonate, or polysulfate, etc., and/or an oxidizing solution, such as hydrogen peroxide ($H_2O_2$) or potassium ferricyanide, etc. An additive pump 51 is preferably installed at a predetermined region of the additive supply conduit 73, and, preferably, the main control unit 19*a* controls operation of additive pump 51. Also, the additive storage unit 9 senses the amount of the additive in additive storage unit 9 and generates a corresponding electrical signal which is transmitted to main control unit 19*a*, thereby controlling the amount of additive supplied to the additive storage unit 9.

The additive in the additive storage unit 9 is preferably circulated through a second circulation loop line 57 and a fourth pump 35, which is installed at the second circulation loop line 57. Also, it is preferable that the main control unit 19*a* controls the operation of the fourth pump 35. The additive supply conduit 73, the additive pump 51, the additive storage unit 9, the second circulation loop line 57, and the fourth pump 35 constitute an additive storage portion 97 of the slurry supply apparatus 10. The additive storage portion 97 may further comprise a filter unit 37, which is preferably installed at the second circulation loop line 57 between the fourth pump 35 and the outlet of the second circulation loop line 57, and an additive supply valve 53, which is preferably installed at the additive supply conduit 73 between the additive pump 51 and the additive storage unit 9.

The diluted slurry and the additive, which are circulated through first and second circulation loop lines 55 and 57, respectively, are mixed together by at least one in-line point-of-use (P.O.U.) mixing unit to a desired ratio. Although this embodiment discloses two P.O.U. mixing units 11 and 13 as shown in FIG. 1, the number of the P.O.U. mixing units may be any number greater than one. Each one of the P.O.U. mixing units 11 and 13 is preferably connected to one CMP machine and controls the mixing ratio of the diluted slurry and the additive independently. Thus, a first P.O.U. mixing unit 11 may provide a first mixed slurry, which is adequate to a first CMP process to be performed at a first CMP machine 15, while a second P.O.U. mixing unit 13 may provide a second mixed slurry, which is adequate to a second CMP process to be performed at a second CMP machine 17.

First and second P.O.U. mixing units 11 and 13 may be controlled by a sub control unit 19*b*. Sub control unit 19*b* monitors a state of first and second P.O.U. mixing units 11 and 13, and transmits control signals to first and second CMP machines 15 and 17, respectively.

In an operation of the slurry supply apparatus 10 according to the preferred embodiment of the present invention, an operator determines a first mixing ratio and a second mixing ratio, for a first and second polishing process, respectively. The operator then inputs the predetermined mixing ratios into the sub control unit 19*b*. When the first CMP machine 15 transmits a first CMP slurry supply signal ϕ414 to the sub control unit 19*b*, the sub control unit 19*b* sends a first CMP slurry valve control signal ϕ16 to a first CMP slurry valve (not shown) and a first CMP additive valve control signal ϕ17 to a first CMP additive valve (not shown) as well as a first CMP slurry flow rate control/monitor signal ϕ11 and a first CMP additive flow rate control/monitor signal ϕ12 to the first P.O.U. mixing unit 11. Signals ϕ16, ϕ17, ϕ11, and ϕ12 cause first P.O.U. mixing unit 11 to create a first mixed slurry having a first mixing ratio. Here, the first CMP slurry flow rate control/monitor signal ϕ11 controls and monitors the flow rate of the first diluted CMP slurry that flows through the first P.O.U. mixing unit 11. The flow rate data for the diluted slurry is preferably continuously transmitted to the sub control unit 19*b*. Similarly, the first additive flow rate control/monitor signal ϕ12 controls and monitors the flow rate of the additive that flows through the first P.O.U. mixing unit 11. The flow rate data for the additive is also preferably continuously transmitted to the sub control unit 19*b*.

The mixing ratio of the mixed slurry that flows out of the first P.O.U. mixing unit 11 may be measured using a first conductivity measurer 81. The first conductivity measurer 81 is preferably installed at a nozzle of the first P.O.U. mixing unit 11 and transmits a measured mixing ratio to the sub control unit 19*b*. In the event that the measured flow rate of the diluted slurry and the measured flow rate of the additive are outside of an allowable range or the measured mixing ratio of the mixed slurry is out of an allowable range, the sub control unit 19*b* transmits a first CMP process stop signal ϕ13 to first CMP machine 15 to halt operation of the first CMP machine 15.

Similarly, when the second CMP machine 17 transmits a second slurry CMP supply signal ϕ24 to the sub control unit 19*b*, the sub control unit 19*b* sends a second CMP slurry valve control signal ϕ26 to a second CMP slurry valve (not shown) and a second CMP additive valve control signal ϕ27 to a second CMP additive valve (not shown), as well as a second CMP slurry flow rate control/monitor signal ϕ21 and a second CMP additive flow rate control/monitor signal 422 to a second P.O.U. mixing unit 13. Signals ϕ26, ϕ27, ϕ21 and ϕ22 cause the second P.O.U. mixing unit 13 to create a second mixed slurry having a second mixing ratio. Here, the second CMP slurry flow rate control/monitor signal ϕ21 controls and monitors the flow rate of the second diluted CMP slurry, which is flowed through the second P.O.U. mixing unit 13. The flow rate data for the diluted slurry is preferably continuously transmitted to the sub control unit 19*b*. The second additive flow rate control/monitor signal ϕ22 controls and monitors the flow rate of the additive that flows through the second P.O.U. mixing unit 13. Flow rate data for the additive is also preferably continuously transmitted to the sub control unit 19*b*.

Moreover, the mixing ratio of the mixed slurry, which flows out of the second P.O.U. mixing unit 13 may be measured using a second conductivity measurer 83. The second conductivity measurer 83 is preferably installed at a nozzle of the second P.O.U. mixing unit 13 and transmits a measured mixing ratio to the sub control unit 19*b*. In the event that the measured flow rate of the diluted slurry and the measured flow rate of the additive are outside of an allowable range or the measured mixing ratio of the mixed slurry is outside of an allowable range, the sub control unit 19*b* transmits a second CMP process stop signal ϕ23 to the second CMP machine 17 to halt the operation of the second CMP machine 17.

When the slurry storage portion 91, the mixing portion 93, the supply portion 95, or the additive storage portion 97 are not in a normal condition (i.e., slurry, diluted slurry, and/or additive is low, etc), the main control unit 19*a* controls the first and second P.O.U. mixing units 11 and 13, respectively, as well as the first and second CMP machines 15 and 17, respectively, through the sub control unit 19*b*. For example, in the event that the measured mixing ratio of the diluted slurry that flows through the first circulation loop line 55 is outside of a desired range, the main control unit 19*a* halts the operations of the first and second P.O.U. mixing units 11 and 13, respectively, and the first and second CMP machines 15 and 17, respectively, through the sub control unit 19*b*. Alternatively, in the event that an exemplary measured mixing ratio of the mixed slurry, which flows out from the first P.O.U. mixing unit 11, is out of an allowed range, the sub control unit 19*b* may control the slurry storage portion 91, the mixing portion 93, the supply portion 95 or the additive storage portion 97 through the main control unit 19*a*.

Each of first and second P.O.U. mixing units 11 and 13, respectively, may include a purging means for removing remnants of an unwanted slurry mixture at a time of a mixture change, in order to prevent contamination of a newly introduced slurry mixture. Such purging may be necessary due to application requirements that necessitate significantly changing a mixing ratio or for changing the type of abrasive used in the slurry.

Figure 2:
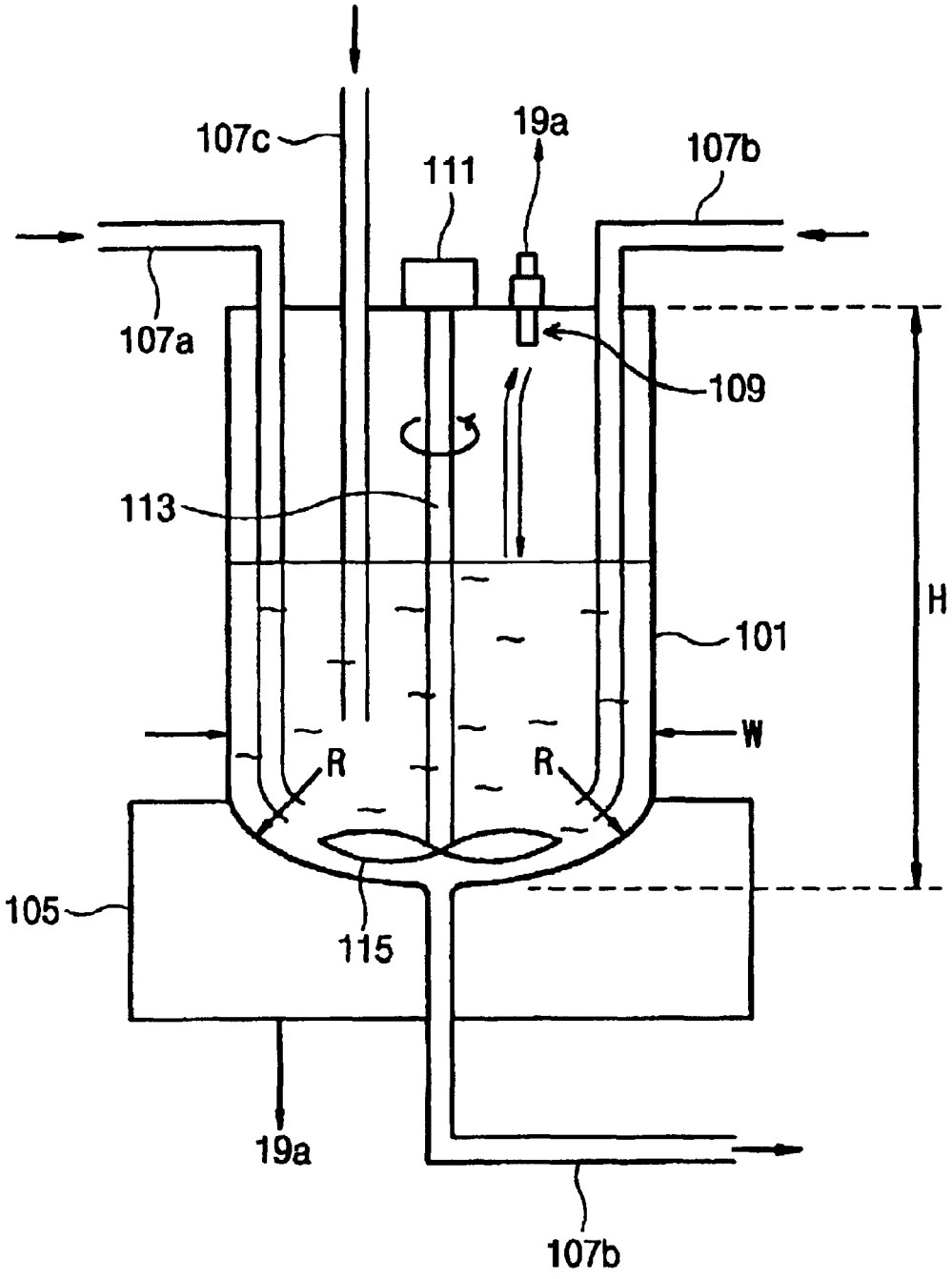
FIG. 2 illustrates a schematic view of a mixing unit shown in FIG. 1.

FIG. 2 illustrates a schematic view of the mixing unit 5 shown in FIG. 1.

Referring to FIG. 2, the mixing unit 5 comprises a mixing tank 101 that mixes and stores the undiluted slurry, which flows out from the slurry supply conduit 107*a* (reference label 65 of FIG. 1), and the diluting solution, which flows out from the diluting solution supply conduit 107*c* (reference label 71 of FIG. 1). The diluted slurry in mixing tank 101 is circulated through the diluted slurry circulation loop line 107*b* (reference label 67 of FIG. 1). It is preferable that the region where the sidewall and the bottom of the mixing tank 101 are in contact with each other has a rounded shape having a predetermined curvature R in order to minimize precipitation and settling of the diluted slurry. Also, it is preferable that the bottom of the mixing tank 101 has a conical shape that inclines downward towards a central portion thereof in order to provide a funneling effect. In the event that the inlet of the diluted slurry circulation loop line 107*b* is connected to the central portion of the bottom of the mixing tank 101, it is possible to efficiently prevent the diluted slurry from seftling or being precipitated. In other words, the outlet of the mixing tank 101 is preferably located at the central portion of the bottom thereof. In addition, a height H of the mixing tank 101 is preferably greater that an inner diameter W thereof in order to minimize settling and precipitation of the diluted slurry inside mixing tank 101 by reducing the relative area of the bottom of the mixing tank 101 as compared to the height dimension of the mixing tank 101.

An outlet of the slurry supply conduit 107*a* and an outlet of the diluted slurry circulation loop line 107*b* are preferably extended to be close to an edge of the bottom of the mixing tank 101. It is also preferable that the outlet of the slurry supply conduit 107*a* and the outlet of the diluted slurry circulation loop line 107*b* are bent towards the central portion of the bottom of the mixing tank 101 as shown in FIG. 2. Such an arrangement produces a turbulence/stirring effect on the solutions entering at the bottom of the mixing tank 101.

The mixing unit 5 may further include an ultrasonic sensor 109 or a load cell 105 that measures the amount of the solution in the mixing tank 101. Such measurement devices are preferable to traditional sensor trees mounted on a sidewall of the mixing unit, which can act as a catalyst for precipitating and solidifying the abrasives in the slurry solution, thereby causing measurement inaccuracies. The ultrasonic sensor 109 may be installed at a lid of the mixing tank 101. The measured amount of the solution in the mixing tank 101 is converted into an electrical signal by the ultrasonic sensor 109, with the electrical signal being transmitted to the main control unit 19*a*.

Alternatively, the load cell 105 is preferably located under the mixing tank 101. In other words, the mixing tank 101 is mounted on the load cell 105. The load cell 105 measures the weight of the mixing tank 101 and the weight of the solution in the mixing tank 101, thereby allowing the net weight of the solution in the mixing tank 101 to be calculated. The measured weight of the solution is converted to an electrical signal, and the electrical signal is transmitted to the main control unit 19*a*.

An exemplary method for mixing the undiluted slurry and the diluting solution to a desired mixing ratio using the load cell 105 may include the following steps. For the purpose of ease and convenience in explanation, It is assumed that the mixing ratio corresponds to a weight ratio.

In a first step, the undiluted slurry is supplied into the mixing tank 101 through the slurry supply conduit 107*a*. The load cell 105 continuously measures the weight of the undiluted slurry while the undiluted slurry is supplied. When the weight of the undiluted slurry in the mixing tank 101 reaches a first desired value, the main control unit 19*a* closes the slurry supply valve 41 and opens the diluting solution valve 49 in a second step.

During a third step, the diluting solution is supplied into the mixing tank 101 via the diluting solution supply conduit 107*c* with the load cell 105 continuously measuring the weight of the mixing tank 101 and its contents. When the net weight of mixing tank 101 and its contents reach a second desired value, e.g., three times that of the first desired value for an exemplary 3:1 ratio, the main control unit 19*a* closes the diluting solution valve 49. Thus, using this method, it is possible to accurately attain a desired mixing ratio of the undiluted slurry and the diluting solution.

It is preferable that the mixing unit 5 further includes a stirring device, which is installed at a central portion of mixing tank 101. The stirring device preferably includes a motor 111 installed at a lid of mixing tank 101, a rotation shaft 113 connected to motor 111 and extended to be close to the central portion of the bottom of mixing tank 101, and a propeller 115 fixed at the lower end of rotation shaft 113. When motor 111 is operated, the diluted slurry in the mixing tank 101 is continuously stirred, thereby preventing the diluted slurry in the mixing tank 101 from settling, precipitating or solidifying.

A configuration similar to that used in the mixing unit 5 may be used in the slurry storage unit 3, the supply unit 7, and the additive storage unit 9. In the preferred embodiment of the present invention as described, the additive storage unit 9 does not include the stirring device, even though it may be included depending on the particular preference.

Figure 3:
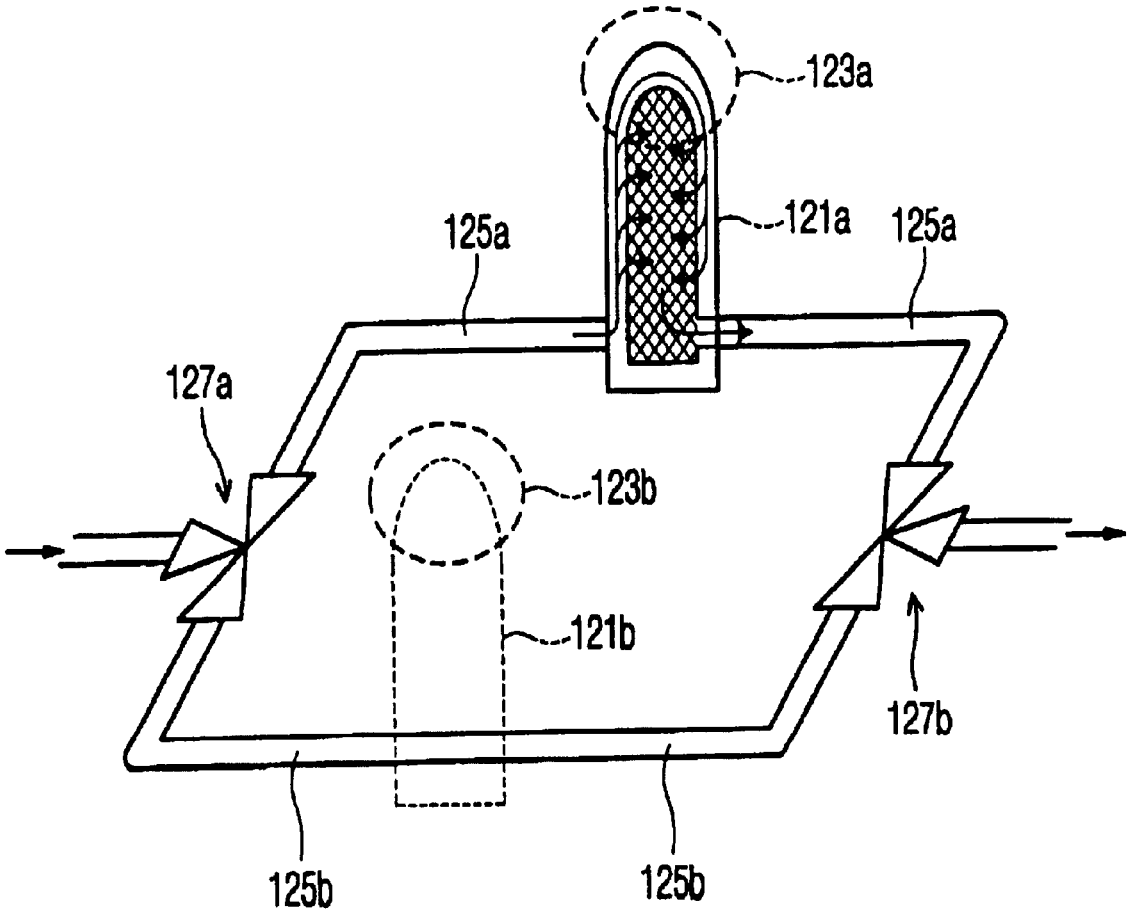
FIG. 3 illustrates a schematic view of a representative filter unit shown in FIG. 1.

FIG. 3 illustrates a schematic view of a representative filter unit for use in filter unit locations 25, 29, 33 and 37 as shown in FIG. 1.

Referring to FIG. 3, each filter unit preferably comprises a first and a second three-way valve 127*a* and 127*b*, respectively, and a first filter 121*a*, which is preferably installed between the first and second three-way valves 127*a* and 127*b*, respectively. The first three-way valve 127*a* has one inlet and two outlets, and the second three-way valve 127*b* has two inlets and one outlet. A first outlet of first three-way valve 127*a* is connected to one end of a first conduit 125*a*, and a first inlet of the second three-way valve 127*b* is connected to the other end of the first conduit 125*a*. The first filter 121*a* is installed at a predetermined region of the first conduit 125*a* in order to filter contaminants that may be contained in a solution that flows through the first conduit 125*a*.

Similarly, a second outlet of the first three-way valve 127*a* is connected to one end of a second conduit 125*b*, and a second inlet of the second three-way valve 127*b* is connected to the other end of the second conduit 125*b*. A second filter 121*b* may be installed at a predetermined region of the second conduit 12*b* to filter contaminants that may be contained in a solution that flows through the second conduit 125*b*. The first and second three-way valves 127*a* and 127*b*, respectively, may be manual valves or electronically controlled valves.

In order to allow a solution to flow from through the filter unit, the first outlet of the first three-way valve 127*a* and the first inlet of second three-way valve 127*b* are opened and the second outlet of first three-way valve 127*a* and the second inlet of second three-way valve 127*b* are closed. More particularly, the solution is introduced into the inlet of the first three-way valve 127*a* and flows through the first conduit 125*a*, the first filter 121*a* and the outlet of the second three-way valve 127*b*. The first filter 121*a* is preferably installed such that a normally "lower portion" or loop portion 123*a* of the first filter 121*a* is oriented to be higher than an inlet port of the first filter 121*a*, as shown in FIG. 3. Such an orientation prevents contaminants in the solution from settling or precipitating inside the loop portion 123*a* of the first filter 121*a* while the solution passes through the first filter 121*a*. Similarly, the second filter 121*b* is preferably installed so that a loop portion 123*b* of the second filter 121*b* has a same upward orientation, as shown in FIG. 3.

When the first filter 121*a* needs to be replaced with a new filter, the second outlet of the first three-way valve 127*a* and the second inlet of the second three-way valve 127*b* are opened, and the first outlet of the first three-way valve 127*a* and the first inlet of the second three-way valve 127*b* are closed. Accordingly, the solution is introduced through the inlet of the first three-way valve 127*a* and flows through the second conduit 125*b*, the second filter 121*b*, and the outlet of the second three-way valve 127*b*. In the event that the second filter 121*b* is not installed, the solution flows through only the second conduit 125*b*. After completing the replacement of the first filter 121*a*, the valves may be returned to their former state (i.e., the first outlet of the first three-way valve 127*a* and the first inlet of the second three-way valve 127*b* are opened, and the second outlet of the first three-way valve 127*a* and the second inlet of the second three-way valve 127*b* are closed). By using a "dual-path" configuration, as just described, it is possible to continuously circulate the solution through the filter unit during the maintenance of the filter unit. Accordingly, since the re-circulation flow of a slurry solution is not allowed to stop, settling, precipitation and/or solidification of the abrasive particles in the undiluted slurry or the diluted slurry is prevented. Also, it is possible to minimize the precipitation of the abrasive particles inside the filter unit by installing the lower, or loop, portion of the filters in an upward orientation.

Figure 4:
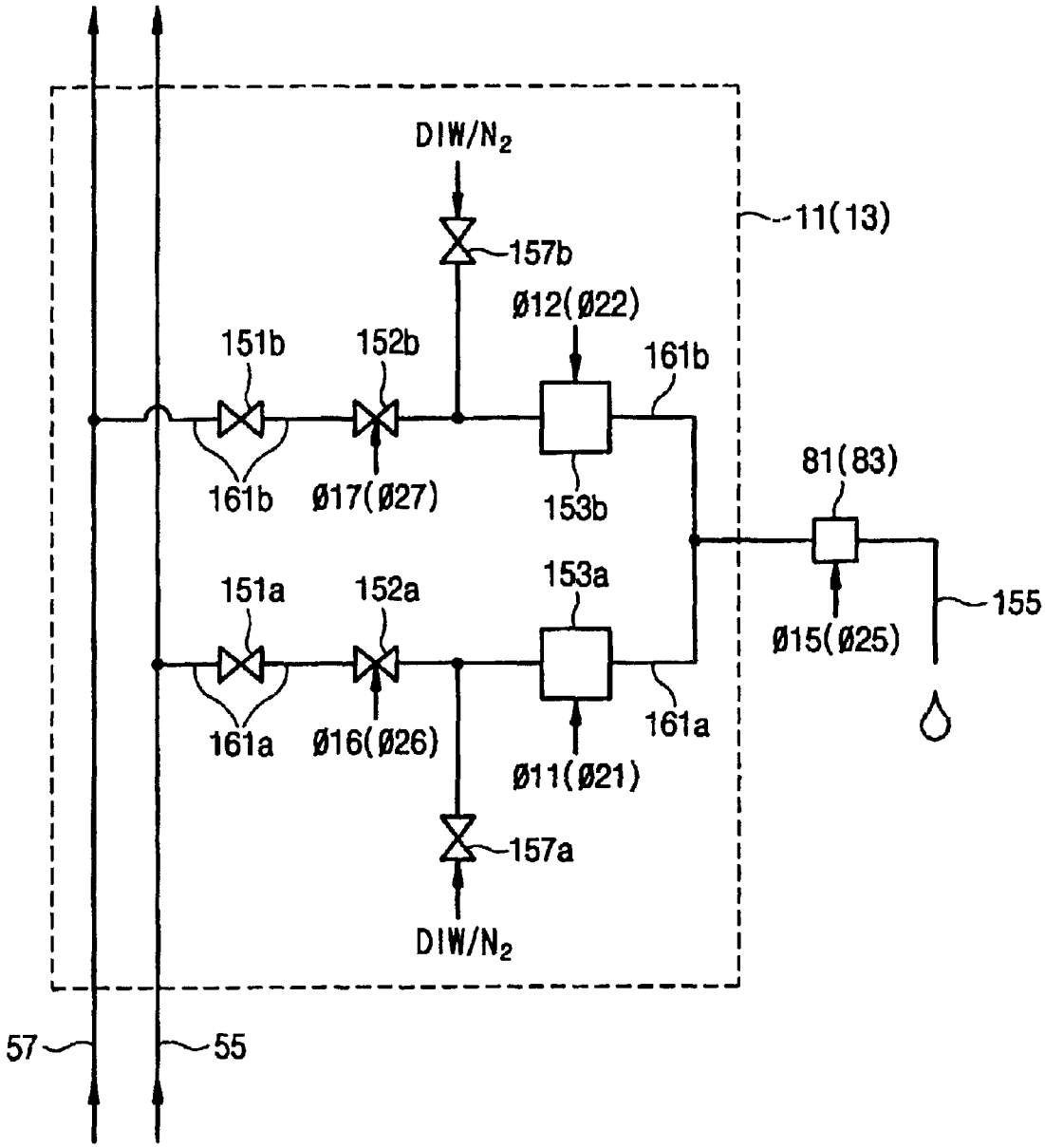
FIG. 4 illustrates a schematic view of a point-of-use (P.O.U.) mixing unit shown in FIG. 1.

FIG. 4 illustrates a schematic view of a representative P.O.U. mixing unit shown in FIG. 1. Specifically, the P.O.U mixing unit 11 is used in conjunction with the following detailed explanation of the operation of the mixing unit in order to better explain the interaction of the previously mentioned signal lines. Since the discussion is not meant to be limiting on the scope of the present invention, a similar explanation also applies to the P.O.U. mixing unit 13 as indicated by the included parenthetic reference labels in FIG. 4.

Referring to FIG. 4, a first conduit 161*a* is branched from a predetermined region of the first circulation loop line 55 shown in FIG. 1. Similarly, a second conduit 161*b* is branched from a predetermined region of the second circulation loop line 57 of FIG. 1. The outputs of the first and second conduits 161*a* and 161*b*, respectively, are preferably connected to a single nozzle 155. Thus, the diluted slurry that flows through the first conduit 161*a* is mixed inside nozzle 155 with the additive that flows through the second conduit 161*b*. Preferably, a first valve 151*a* is installed at a predetermined region of the first conduit 161*a*, and a second valve 151*b* is installed at a predetermined region of second conduit 161*b*. As mentioned previously, the first and second valves may be manual or electronically controlled valves.

A first flow rate controller 153*a* is preferably installed at a region of the first conduit 161*a* between the first valve 151*a* and the outlet of the first conduit 161*a*, and a second flow rate controller 153*b* is installed at a region of the second conduit 161*b* between the second valve 151*b* and the outlet of the second conduit 161*b*. The first flow rate controller 153*a* is preferably controlled by a first slurry flow rate control/monitor signal $\phi$11, which is outputted from the sub control unit 19*b* of FIG. 1. Similarly, the second flow rate controller 153*b* is preferably controlled by the first additive flow rate control/monitor signal $\phi$12, which is also outputted from the sub control unit 19*b*. Thus, the amount of diluted slurry that flows through the first flow rate controller 153*a* and the amount of the additive that flows through the second flow rate controller 153*b* can be appropriately controlled according to a desired mixing ratio. Accordingly, the mixing ratio of the diluted slurry and the additive may be changed in real time according to requirements and needs of a particular polishing process.

A first automated valve 152*a* is preferably installed at a region of the first conduit 161*a* between the first valve 151*a* and the first flow rate controller 153*a*. Similarly, a second automated valve 152*b* is preferably installed at a region of the second conduit 161*b* between the second valve 151*b* and the second flow rate controller 153*b*. The first automated valve 152*a* may be opened or closed by the first slurry valve control signal ϕ16, which is outputted from the sub control unit 19*b*. The second automated valve 152*b* may be opened or closed by the first additive valve control signal ϕ17, which is also outputted from sub control unit 19*b* of FIG. 1. In addition, a first conductivity measurer 81 is preferably installed at or near the nozzle 155 in order to measure a mixing ratio of the mixed slurry that flows through the nozzle 155 and transmit the measured result to the sub control unit 19*b*.

In order to change slurry mixtures, purge lines are preferably installed to remove old mixtures and rinse the delivery conduits before introducing the new slurry mixtures. Accordingly, a first purge line having a first purge valve 157*a* is preferably branched from the first conduit 161*a* between the first automated valve 152*a* and the first flow rate controller 153*a*. Similarly, a second purge line having a second purge valve 157*b* is preferably branched from a second conduit 161*b* between the second automated valve 152*b* and the second flow rate controller 153*b*.

By way of example, in order to effect a clean change of a mixing ratio of the mixed slurry for a new polishing process, a previous slurry mixture is first purged and removed from the first conduit 161*a*, the second conduit 161*b* and the nozzle 155. The purging process may be accomplished by closing the first and second valves 151*a* and 151*b*, respectively, opening the first and second purge valves 157*a* and 157*b*, respectively, and introducing de-ionized water and an inert gas, such as nitrogen, into the first and second purge lines. In this manner, the purging process may be conducted while the diluted slurry in the supply portion 95 and the additive in the additive storage portion 97 are concurrently and continuously circulated through the first and second circulation loop lines 55 and 57, respectively, to prevent the abrasive particles in the diluted slurry from settling, precipitated or solidified.

In the meantime, properties of the mixture of the diluted slurry and the additive, such as a polishing selectivity of the mixed slurry, may be changed over time. In the graph shown in FIG. 5, the horizontal axis represents time (T), and the vertical axis represents the polishing selectivity of the mixed slurry. In other words, the mixture may be changed by introducing more or less diluted slurry relative to the amount of additive, which over time attains a new mixing ratio equilibrium.

Figure 5:
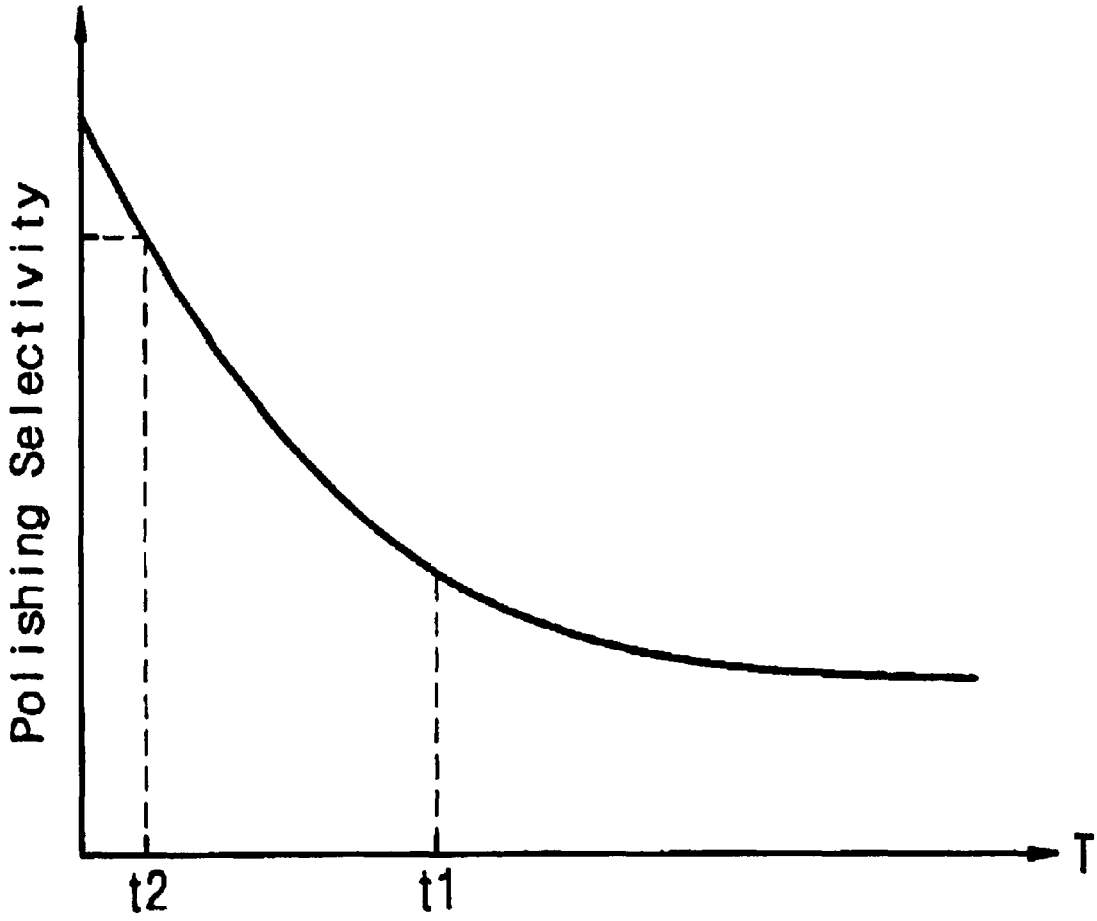
FIG. 5 is a graph showing a plot of a polish selectivity property versus time for a particular slurry.

According to the representative graph shown in FIG. 5, the polishing selectivity of the mixed slurry is gradually reduced over time until a first time (t1). However, if the time T elapses beyond first time (t1), the polishing selectivity becomes more saturated. Thus, as the length of the nozzle 155 increases, there is a greater fluctuation in the polishing selectivity of the mixed slurry. This is due to changes in speed of the running mixture as a result of changes in the first and second flow rate controllers 153*a* and 153*b*, respectively, shown in FIG. 4. Accordingly, when the flow rate of the diluted slurry is sufficiently high, the time duration that the diluted slurry exists in the nozzle 155 is short, and, the polishing selectivity may be increased. As the length of the nozzle 155 increases, it becomes increasing difficult to obtain high polishing selectivity, and as a result, throughput and reliability of the polishing process become degraded.

It is therefore preferable to maintain the length of the first and second conduits 161*a* and 161*b*, respectively, as shown in FIG. 4, as short as possible, in order to keep the purging operation efficient and to minimize the quantity of purged slurry. If the length of the first conduit 161*a* is too long, a greater amount of diluted slurry will exist in the first conduit, and as a result, there is a greater potential for settling, precipitation or solidification.

According to the present invention, it is preferable that the P.O.U. mixing units 11 and 13 are located close to the CMP machines in order to minimize the lengths of the first and second conduits 161*a* and 161*b*, respectively, as well as the length of the nozzle. If the P.O.U. mixing units 11 and 13 are located close to the CMP machines, it will take a second time (t2) for the mixed slurry to reach the outlet of the nozzle. Accordingly, as the second time (t2) is decreased, the less the variation in second time (t2) for a given change in polishing selectivity. As a result, as the distance between the P.O.U. mixing units and the CMP machines becomes closer, greater uniformity of the mixed slurry is achieved.

As stated above, it is preferable that the branch points of the first and second conduits 151*a* and 151*b* as well as the first and second valves 151*a* and 151*b* be located inside the P.O.U. mixing units 11 and 13 in order to minimize the fluctuation in the physical properties of the mixed slurry as shown in FIG. 5.

A preferred method for supplying a slurry mixture to the first and/or second CMP machines will now be explained with reference to FIGS. 1 to 4.

In a first step, slurry particles in the undiluted slurry are uniformly dispersed by shaking slurry bottle 1, which contains the undiluted slurry. In a second step, the first slurry valve 21 is opened, the second slurry valve 47 is closed, and the first pump 23 is operated to transfer a predetermined amount of the undiluted slurry from the slurry bottle 1 into the slurry storage tank of the slurry storage unit 3 via the slurry conduit 61 and the slurry circulation loop line 63. Simultaneously, a stirring device of the slurry storage tank is operated to continuously agitate the slurry stored in the slurry storage tank, thereby preventing the slurry in the slurry storage tank from settling, precipitating or solidifying.

In a third step, the slurry circulation valve 39 is opened, and the first pump 23 is continuously operated to self-circulate the slurry in the slurry storage tank via the slurry circulation loop line 63. In a fourth step, the slurry supply valve 41 is opened, thereby supplying the undiluted slurry from the slurry storage tank into the mixing tank of the mixing unit 5. When a desired amount of the slurry is transferred to the mixing tank, the slurry supply valve 41 is automatically closed by the main control unit 19*a*, and in a fifth step, the diluting solution valve 49 is opened to supply the diluting solution into the mixing tank of the mixing unit 5.

In a sixth step, when a desired amount of the diluting solution has been added to the mixing tank, the diluting solution valve 49 is automatically closed by the main control unit 19*a*, thereby completing a mixing of the undiluted slurry and the diluting solution, e.g., the diluted slurry is formed in the mixing tank. Here, the mixing ratio of the diluted slurry may be controlled using methods other than the above-mentioned method and still be within the scope of the invention. A stirring device installed at the mixing tank is preferably operated to continuously agitate the diluted slurry in the mixing tank.

In a seventh step, the diluted slurry circulation valve 43 is opened, and the second pump 27 is operated to self-circulate the diluted slurry in the mixing tank via the diluted slurry circulation loop line 67, thereby preventing the diluted slurry in the mixing tank from settling, precipitating or solidifying.

In an eighth step, the diluted slurry supply valve 45 is opened, and a portion of the diluted slurry is supplied into the supply tank of the supply unit 7 of the supply portion 95. In a ninth step, when the amount of the diluted slurry in the supply tank reaches an upper limit value, the diluted slurry supply valve 45 is automatically closed by the main control unit 19*a*.

The diluted slurry stored in the supply tank is stirred by operating a stirring device installed at the supply tank. In addition, a third pump 31 is operated to continuously circulate the diluted slurry in the supply tank through the first circulation loop line 55, thereby preventing the diluted slurry in supply portion 95 from settling, precipitating or solidifying. In a tenth step, the mixing ratio of the diluted slurry in the first circulation loop line 55 is preferably continuously measured using conductivity measurer 32, which transmits a corresponding signal to the main control unit 19*a*.

In an eleventh step, main control unit 19*a* compares the measured mixing ratio with a reference mixing ratio, which is set by the operator. In the event that the difference between the measured mixing ratio and the reference mixing ratio is outside of an allowable range, the slurry supply valve 41 and the diluting solution valve 49 of the mixing portion 93 are controlled by the main control unit 19*a* to provide a diluted slurry having a desired mixing ratio.

In a twelfth step, the additive pump 51 is operated to control the supply of additive in the additive storage tank of the additive storage unit 9. In the event that the amount of the additive in the additive storage tank reaches an upper limit value, the operation of the additive pump 51 is halted. Alternatively, in the event that the amount of the additive in the additive storage tank reaches a lower limit value, the additive pump 51 is operated to supply the additive into the additive storage tank. In a thirteenth step, the fourth pump 35 is operated to circulate the additive in the additive storage tank through the second circulation loop line 57.

In a fourteenth step, at least one of the first and second P.O.U. mixing units 11 and 13, respectively, mixes to a predetermined mixing ratio the diluted slurry which is circulated through the first circulation loop line 55 with the additive solution which is circulated through the second circulation loop line 57. The resulting mixed slurry is supplied to one or more associated CMP machines 15 and 17 through an associated nozzle 155. Here, each of the first and second P.O.U. mixing units 11 and 13, respectively, is controlled by the sub control unit 19*b*.

In a fifteenth step, at the completion of a polishing process using the associated CMP machine 15, first and second manual valves 151*a* and 151*b*, respectively, are closed, first and second purge valves 157*a* and 157*b*, respectively, are opened, and the de-ionized water and the nitrogen gas are sequentially introduced into the first and second purge lines. Accordingly, the diluted slurry and the additive that exist in first and second conduits 161*a* and 161*b*, respectively, as well as the mixed slurry that exists in the nozzle 155 are completely removed.

In the foregoing discussion, a preferred embodiment of a slurry delivery system is disclosed. One or more of the specific elements included in the preferred embodiment may be omitted in alternate embodiments, and still remain within the scope of the invention. Further, according to the preferred embodiment of the present invention, 1) the slurry is pre-mixed and continuously re-circulated to prevent settling, precipitation and/or solidification of the abrasives in the mixed slurry, and 2) chemical additives are only supplied and mixed at the P.O.U. mixing units at or near the CMP machine and the polishing application, thereby avoiding time limitations associated with adding a curing-type material to a slurry solution. In the re-circulation of the mixed slurry, it can be appreciated that the return conduit may be directed either to the supply tank 7 or to the mixing tank 5 and still maintain the agitation of the mixed slurry, since the two tanks contain the same solution.

Figure 6:
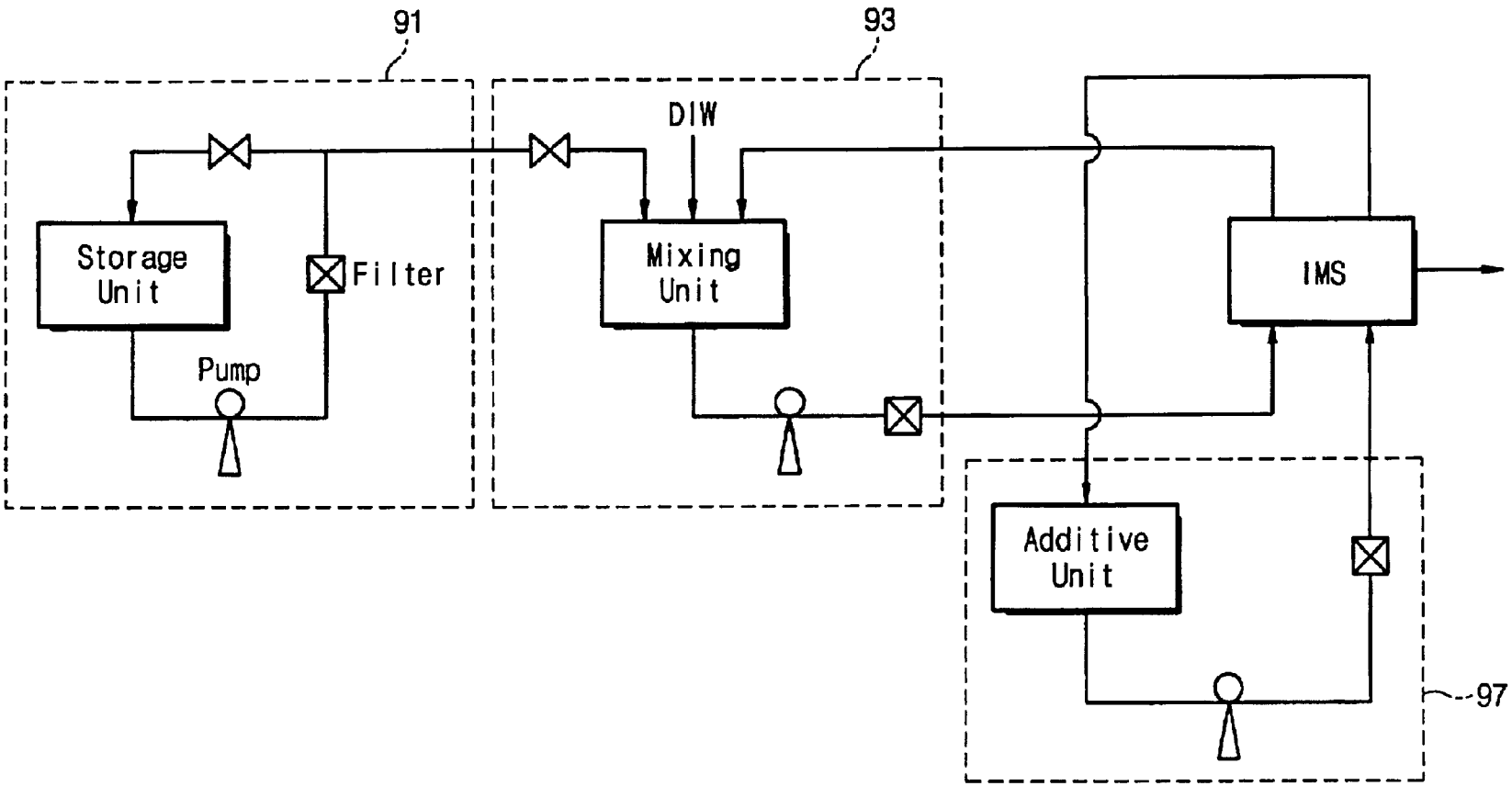
FIG. 6 illustrates a schematic diagram of a slurry supply apparatus according to a second embodiment of the present invention.

FIG. 6 illustrates a schematic diagram of a slurry supply apparatus according to a second embodiment of the present invention. The second embodiment in similar to the preferred embodiment, except that the pre-mixed slurry is preferably routed directly to the P.O.U. mixing unit, without the use of an intermediate supply portion 95 as shown in FIG. 1. Such an embodiment would thus preferably comprise a slurry storage portion 91, a mixing portion 93, an additive storage portion 97, and one or more P.O.U. mixing units for mixing the diluted slurry and the additive at or near the point of use. The salient features of this embodiment are that 1) the slurry is pre-mixed in the mixing portion 93 and re-circulated through the P.O.U units and back through the mixing portion 93, and 2) that the additive is mixed at or near the point of use.

Figure 7:
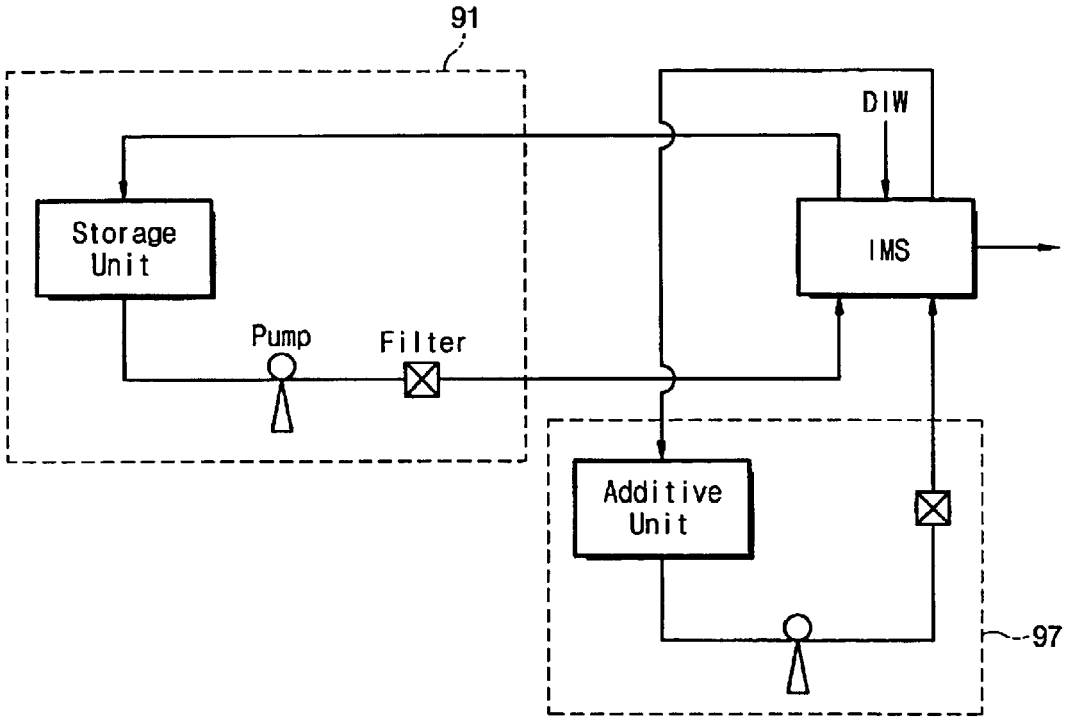
FIG. 7 illustrates a schematic diagram of a slurry supply apparatus according to a third embodiment of the present invention.

FIG. 7 illustrates a schematic diagram of a slurry supply apparatus according to a third embodiment of the present invention. In this embodiment, the mixing portion 93 of the second embodiment is effectively combined with the P.O.U. mixing unit to yield a single mixing unit at or near point of use. Diluting solution is added and mixed in the P.O.U mixing unit along with the additive solution. Undiluted slurry from the storage portion 91 is re-circulated through the P.O.U. mixing unit and back through the storage portion 91. Thus, the third embodiment preferably comprises a slurry storage portion 91, an additive storage portion 97, and one or more P.O.U. mixing units for mixing the diluted slurry and the additive at or near the point of use.

It can be appreciated by one having ordinary skill in the art that the relative sizes of the various mixing and storage tanks determine the amount of "old" slurry mix that must be purged before a "new" slurry mix can be introduced into the system without polishing selectivity degradation. It is obviously desirable to be able to re-use as much of an "old" solution as possible. For ratio changes using a same abrasive, ratio adjustments are relatively easy to make. The inherent flexibility of the present invention allows such changes with minimum impact, cost and down time.

However, for changes of abrasive, such as from a silica-based slurry to a ceria-based slurry, either the entire system must be purged and cleaned or a parallel system must be created that may be "switched in" as desired. The engineering trade-off revolves on how often such a change must be made during manufacturing versus the expense and manufacturing space required for maintaining parallel systems.

As long as ratio-changes are small, they can be relatively easily accommodated by weighted calculations using existing slurry vs. an amount of new slurry that must be provided to implement a desired change in the entire amount of slurry retained in the system, with an attendant time delay associated with the mixing and re-circulatory mixing effects to obtain a satisfactory "new" equilibrium solution.

In a simplified example, assume that a specific amount of pre-mixed silica-based slurry, having an exemplary weighted mixing ratio of 3:1, i.e., three parts undiluted slurry to one part diluting agent, exists in all of the "unpurged" elements of mixing portion 93, supply portion 95, and P.O.U mixing units 11 and 13. Assume also that the ratio is to be changed to 2.5:1. If the amount of available weighted space for new material in mixing portion 93 comprises 10% of the total weight of existing slurry, then a weight calculation may be made to arrive at an optimum amount of additional diluting solution that needs to be added to bring the entire amount of slurry to the desired 2.5:1 ratio.

For purposes of explanation, without limitation, for an exemplary 100 pound (lbs) of "old" slurry existing in the elements of the system, with the above 10 lbs of available space for adding new material, the existing quantity of undiluted slurry is 75 lbs and the existing quantity of diluting solution is 25 lbs (a 3:1 ratio.) The quantity of additional diluting solution required to achieve the overall 2.5:1 ratio is 5 lbs to give an overall weight of undiluted slurry of 75 lbs and an overall weight of diluting solution of 30 lbs (2.5:1 ratio.) It can be appreciated that ordinarily adding pure diluting agent would not be particularly desirable, given the amount of mixing time required to uniformly mix the "new solution," but rather a more graduated approach using incrementally changing proportions of the two solutions would allow faster attainment of acceptable uniformity conditions. Occasionally, such measures may be required, and may include having to purge solution from supply unit 7 of supply portion 95 of slurry supply apparatus 10 to create available space for new materials.

A preferred embodiment of the present invention has been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the invention as set forth in the following claims.

What is claimed is:

1. A method of circulating and dispensing a solution onto a surface of a semiconductor wafer, comprising:

introducing a first solution to a storage tank;

pumping and circulating the first solution through a circulation loop between the storage tank and an in-line mixing unit, the in-line mixing unit having a dispensing conduit and a first solution flow control valve;

controlling, via the first solution flow control valve, the flow of the first solution from the storage tank;

controlling the first solution flow control valve via a controller; and dispensing, via the in-line mixing unit, the first solution onto the surface of the semiconductor wafer through the dispensing conduit in response to a signal from the controller.

2. A method of circulating and dispensing a solution onto a surface of semiconductor wafer, comprising:

introducing a first solution to a storage tank;

pumping and circulating the first solution through a circulation loop between the storage tank and an in-line mixing unit, the in-line mixing unit having a dispensing conduit and a first solution flow control valve;

controlling, via the first solution flow control valve, the flow of the first solution from the storage tank;

controlling the first solution flow control valve via a controller;

introducing a second solution to an additive tank;

pumping and circulating the second solution through a circulation loop between the additive tank and the in-line mixing unit, the in-line mixing unit having a second solution flow control valve;

controlling, via the second solution flow control valve, the flow of the second solution from the additive tank;

controlling the second solution flow control valve via the controller;

introducing, in response to a signal from the controller, the second solution to the in-line mixing unit via the second solution flow control valve, and mixing, via the in-line mixing unit, the second solution with the first solution to form a first mixed solution; and dispensing, via the in-line mixing unit, the first mixed solution onto the surface of the semiconductor wafer through the dispensing conduit.

3. The method as claimed in claim 2, wherein the second solution is at least one additive selected from the group consisting of polymeric solutions and oxidizing solutions.

4. The method as claimed in claim 2, wherein the first mixed solution comprises a mixture of the first solution and a diluting solution.

5. The method as claimed in 4, wherein the diluting solution is de-ionized water.

6. The method as claimed in claim 2, wherein the second solution is at least one additive selected from the group consisting of polymeric solutions and oxidizing solutions.

7. A method of circulating and dispensing a solution onto a surface of a semiconductor wafer, comprising:

introducing a first solution to a storage tank;

pumping and circulating the first solution through a circulation loop between the storage tank and an in-line mixing unit, the in-line mixing unit having a dispensing conduit and a first solution flow control valve;

controlling, via the first solution flow control valve, the flow of the first solution from the storage tank;

controlling the first solution flow control valve via a controller; and introducing a second solution to an additive tank;

pumping and circulating the second solution through circulation loop between the additive tank and the in-line mixing unit, the in-line mixing unit having a second solution flow control valve;

controlling, via the second solution flow control valve, the flow of the second solution from the additive tank;

controlling the second solution flow control valve via the controller;

introducing, in response to a first signal from the controller, the second solution to the in-line mixing unit via the second solution flow control valve, and mixing, via the in-line mixing unit, the second solution with the first solution to form a first mixed solution; and introducing, in response to a second signal from the controller, a third solution to the in-line mixing unit via a third solution flow control valve and mixing, via the in-line mixing unit, the third solution with the first and second solutions to form a second mixed solution; and dispensing the second mixed solution onto the surface of the semiconductor wafer through the dispensing conduit.

8. The method as claimed in 7, wherein the third solution is de-ionized water.

9. The method as claimed in claim 7, wherein the first mixed solution comprises a mixture of the first solution and a diluting solution.

10. The method as claimed in 9, wherein the diluting solution is de-ionized water.

11. The method as claimed in claim 7, wherein the second solution is at least one additive selected from the group consisting of polymeric solutions and oxidizing solutions.

12. A method of circulating and dispensing a solution onto a surface of a semiconductor wafer, comprising:

introducing a first solution to a storage tank having a circulation loop for pumping and circulating the first solution;

pumping the first solution from the storage tank to a mixing tank to create a first mixed solution;

pumping and circulating the first mixed solution between the mixing tank and an in-line mixing unit, the in-line mixing unit having a dispensing conduit and at least one flow control valve;

controlling, via the flow control valve, the flow of the first mixed solution from the mixing tank;

controlling the flow control valve via a controller;

introducing a second solution to an additive tank;

pumping and circulating the second solution through a circulation loop between the additive tank and the in-line mixing unit, the in-line mixing unit having a second solution flow control valve;

controlling, via the second solution flow control valve, the flow of the second solution from the additive tank;

controlling the second solution flow control valve via the controller;

introducing, in response to a signal from the controller, the second solution to the in-line mixing unit via the second solution flow control valve and mixing, via the in-line mixing unit, the second solution with the first mixed solution to form a second mixed solution; and dispensing, via the in-line mixing unit, the second mixed solution onto the surface of the semiconductor wafer through the dispensing conduit.

13. The method as claimed in claim 12, wherein the first mixed solution comprises a mixture of the first solution and a diluting solution.

14. The method as claimed in claim 13, wherein the diluting solution is de-ionized water.

15. The method as claimed in claim 12, wherein the second solution is at least one additive selected from the group consisting of polymeric solutions and oxidizing solutions.

16. A method of circulating and dispensing a solution onto a surface of a semiconductor wafer, comprising:

introducing a first solution to a storage tank having a circulation loop for circulating the first solution;

pumping the first solution from the storage tank to a mixing tank to create a first mixed solution;

pumping the first mixed solution from the mixing tank to a supply tank;

pumping and circulating the first mixed solution between the supply tank and an in-line mixing unit, the in-line mixing unit having a dispensing conduit and at least one solution flow control valve;

controlling, via the solution flow control valve, the flow of the first mixed solution from the supply tank;

controlling the solution flow control valve via a controller; and dispensing, via the in-line mixing unit, the first mixed solution onto the surface of the semiconductor wafer through the dispensing conduit in response to a signal from the controller.

17. The method as claimed in claim 16, wherein the first mixed solution comprises a mixture of the first solution and a diluting solution.

18. The method as claimed in 17, wherein the diluting solution is de-ionized water.

19. A method of circulating and dispensing a solution onto a surface of a semiconductor wafer, comprising:

introducing a first solution to a storage tank having a circulation loop for circulating the first solution;

pumping the first solution from the storage tank to a mixing tank to create a first mixed solution;

pumping the first mixed solution from the mixing tank to a supply tank;

pumping and circulating the first mixed solution between the supply tank and an in-line mixing unit, the in-line mixing unit having a dispensing conduit and at least one solution flow control valve;

controlling, via the solution flow control valve, the flow of the first mixed solution from the supply tank;

controlling the solution flow control valve via a controller;

introducing a second solution to an additive tank;

pumping and circulating the second solution through a circulation loop between the additive tank and the in-line mixing unit, the in-line mixing system having a second solution flow control valve;

controlling, via the second solution flow control valve, the flow of the second solution from the additive tank;

controlling the second solution flow control valve via the controller;

introducing, in response to a signal from the controller, the second solution to the in-line mixing unit by the second solution flow control valve and mixing the second solution with the first mixed solution by the in-line mixing unit to form a second mixed solution; and dispensing, via the in-line mixing unit, the second mixed solution onto the surface of the semiconductor wafer through the dispensing conduit.

20. The method as claimed in claim 19, wherein the second solution is at least one additive selected from the group consisting of polymeric solutions and oxidizing solutions.

21. A system for circulating and dispensing a solution onto a surface of a semiconductor wafer, comprising:

a storage tank having a first circulation loop for circulating a first solution between the storage tank and an in-line mixing unit, the in-line mixing unit having a dispensing conduit; and an additive tank having a second circulation loop for circulating a second solution between the additive tank and the in-line mixing unit, whereby the in-line mixing unit dispenses a first mixed solution comprising the first and second solutions onto the surface of the semiconductor wafer through the dispensing conduit in response to a signal from a controller.

22. The system as claimed in 21, further comprising a second solution flow control valve controlled by the controller, the second solution flow control valve controlling the flow of a second solution for controlled mixing with the first solution to form a first mixed solution, whereby the in-line mixing unit dispenses the first mixed solution onto the surface of the semiconductor wafer through the dispensing conduit.

23. The system as claimed in claim 22, further comprising a third solution flow control valve controlled by the controller, the third solution flow control valve controlling the flow of a third solution for controlled mixing with the first and second solution to form a second mixed solution, whereby the in-line mixing unit dispenses the second mixed solution onto the surface of the semiconductor wafer through the dispensing conduit.

24. A system for circulating and dispensing a solution onto a surface of a semiconductor wafer, comprising:

a storage tank having a circulation loop for circulating a first solution;

a mixing tank for creating a first mixed solution from the first solution and a second solution, and having a first circulation loop to circulate the first mixed solution between the mixing tank and an in-line mixing unit, the in-line mixing unit having a dispensing conduit;

an additive tank having a second circulating line to circulate a third solution between the additive tank and the in-line mixing unit, whereby the in-line mixing unit dispenses a second mixed solution comprising the first mixed solution and a third solution onto the surface of the semiconductor wafer through the dispensing conduit in response to a signal from a controller.

25. The system as claimed in claim 24, further comprising a second solution flow control valve controlled by the controller, the second solution flow control valve controlling the flow of a third solution for controlled mixing with the first mixed solution to form a second mixed solution, whereby the in-line mixing unit dispenses the second mixed solution onto the surface of the semiconductor wafer through the dispensing conduit.

26. A system for circulating and dispensing a solution onto a surface of a semiconductor wafer, comprising:

a storage tank having a circulation loop for circulating a first solution;

a mixing tank for creating a first mixed solution from the first solution and a second solution;

a supply tank for receiving the first mixed solution from the mixing tank and having a first circulating loop to circulate the first mixed solution between the mixing tank and an in-line mixing unit, the in-line mixing unit having a dispensing unit;

an additive tank having a second circulating line for circulating a third solution from the additive tank to the in-line mixing unit, whereby the in-line mixing unit dispenses a second mixed solution comprising the first mixed solution and a third solution onto the surface of the semiconductor wafer through the dispensing conduit in response to a signal from a controller.

27. The system as claimed in claim 26, further comprising a second solution flow control valve controlled by the controller, the second solution flow control valve controlling the flow of a third solution for controlled mixing with the first mixed solution to form a second mixed solution, whereby the in-line mixing unit dispenses the second mixed solution onto the surface of the semiconductor wafer through the dispensing conduit.

28. A method of circulating and dispensing a solution onto a surface of a semiconductor wafer, comprising:

introducing a first solution to a storage tank;

pumping and circulating the first solution through a first circulation loop between the storage tank and an in-line mixing unit, the in-line mixing unit having a dispensing conduit;

introducing a second solution to a additive tank;

pumping and circulating the second solution through a second circulation loop between the additive tank and the in-line mixing unit;

mixing, via the in-line mixing unit, the second solution with the first solution to form a mixed solution; and dispensing, via the in-line mixing unit, the mixed solution onto the surface of the semiconductor wafer through the dispensing conduit.

29. A method of circulating and dispensing a solution onto a surface of a semiconductor wafer, comprising:

introducing a first solution to a storage tank having a first circulation loop for pumping and circulating the first solution;

pumping the first solution from the storage tank to a mixing tank to create a first mixed solution;

pumping and circulating the first mixed solution between the mixing tank and an in-line mixing unit, the in-line mixing unit having a dispensing conduit;

introducing a second solution to an additive tank;

pumping and circulating the second solution through a second circulation loop between the additive tank and the in-line mixing unit;

mixin, via the in-line mixing unit, the second solution with the first mixed solution to form a second mixed solution; and dispensing, via the in-line mixing unit, the second mixed solution onto the surface of the semiconductor wafer through the dispensing conduit.

30. A method of circulating and dispensing a solution onto a surface of a semiconductor wafer, comprising:

introducing a first solution to a storage tank having a first circulation loop for circulating the first solution;

pumping the first solution from the storage tank to a mixing tank to create a first mixed solution;

pumping the first mixed solution from the mixing tank to a supply tank;

pumping and circulating the first mixed solution between the supply tank and an in-line mixing unit, the in-line mixing unit having a dispensing conduit;

introducing a second solution to an additive tank;

pumping and circulating the second solution through a second circulation loop between the additive tank and the in-line mixing unit;

mixing the second solution with the first mixed solution by the in-line mixing unit to form a second mixed solution; and dispensing, via the in-line mixing unit, the second mixed solution onto the surface of the semiconductor wafer through the dispensing conduit.

* * * * *